United States Patent [19]

Kowaka et al.

[11] 4,035,182

[45] July 12, 1977

[54] NI-CR-FE ALLOY HAVING AN IMPROVED RESISTANCE TO STRESS CORROSION CRACKING

[75] Inventors: Masamichi Kowaka, Toyanaka; Hisao Fujikawa, Nishinomiya, both of Japan

[73] Assignee: Sumitomo Metal Industries Ltd., Japan

[21] Appl. No.: 512,966

[22] Filed: Oct. 7, 1974

Related U.S. Application Data

[63] Continuation-in-part of Ser. No. 390,227, Aug. 21, 1973, abandoned, which is a continuation of Ser. No. 161,290, July 9, 1971, abandoned.

[30] Foreign Application Priority Data

July 14, 1970 Japan ..... 45-62464

[51] Int. Cl.[2] ..... C22C 38/02; C22C 38/42

[52] U.S. Cl. ..... 75/122; 75/125; 75/134 F

[58] Field of Search ..... 75/122, 134 F, 124, 75/125, 128 A, 128 V, 128 G, 128 C, 128 W, 128 Z

[56] References Cited

U.S. PATENT DOCUMENTS

| | | | |
|---|---|---|---|
| 2,873,187 | 2/1959 | Dyrkacz | 75/124 |
| 3,300,347 | 1/1967 | Kasza et al. | 75/128 W |
| 3,592,632 | 7/1971 | Gibson | 75/124 |
| 3,859,082 | 1/1975 | Denhard, Jr. et al. | 75/128 W |

*Primary Examiner*—Arthur J. Steiner
*Attorney, Agent, or Firm*—Bucknam and Archer

[57] ABSTRACT

Herein disclosed is an Ni-Cr-Fe alloy being substantially in the single phase of austenite and improved in resistance to stress corrosion cracking. The alloy contains, by weight; 0.03 to 0.12% of carbon; 0.2 to 4% of silicon; 0.1 to 3% of manganese; 12 to 45% of nickel; 15 to 35% of chromium; vanadium and/or aluminum, the total amount of vanadium and aluminum being in the range of 0.2 to 4.0%, titanium in an amount of at least 5 times the carbon content and up to 1% of the total composition, and/or niobium in an amount of at least 7 times the carbon content and up to 1% of the total composition, and/or zirconium in an amount of at least 7 times the carbon content and up to 1% of the total composition, and/or tungsten in an amount of at least 5 times the carbon content and up to 2% of the total composition, the total amount of titanium and/or niobium and/or zirconium and/or tungsten being in the range of 0.3 to 2%; if desired, copper and/ or molybdenum in a total amount of 0.3 to 4%; and the balance of iron. This alloy has outstanding utility as structural material of heat exchanger, such as U-shaped tube of the nuclear reactor.

4 Claims, No Drawings

NI-CR-FE ALLOY HAVING AN IMPROVED RESISTANCE TO STRESS CORROSION CRACKING

This is a continuation-in-part of U.S. patent application Ser. No. 390,227 filed on August 21, 1973, which is turn is a continuation of Ser. No. 161,290, filed on July 9, 1971, both of which are now abandoned.

This invention relates to Ni-Cr-Fe alloys improved in resistance to stress corrosion cracking, and more particularly to Ni-Cr-Fe alloys improved in resistance to the stress corrosion cracking which is liable to occur in pure water, chlorine ion containing water or vapour thereof at high temperatures and high pressures.

In recent years, demand for stainless steels or Ni-Cr-Fe alloys excellent in resistance to stress corrosion cracking, particularly in the application to heat exchangers, has increased with the development of the nuclear and chemical industries. For instance, in power reactors, the heat exchanger is employed to transfer heat from the reactor coolant to the working fluid used in power generation. In the case of pressurized water reactors, the heat exchangers transfer heat from the reactor coolant to a secondary water steam. And in the case of boiling water reactors, steam is generated in the reactor vessel proper. However, in some designs an external heat exchanger is employed in generate additional steam. In these cases the heat exchangers are subjected to a severe corrosive environment of pure water, chlorine ion containing water or vapor thereof at high temperatures and high pressures, for instance, at temperatures up to about 350° C and pressures up to about 200 kg/cm$^2$.

In view of the radioactivity associated with reactor coolants, leakage specifications in such heat exchanger are very stringent. It is well known that heat exchangers made of Ni-Cr stainless steels or Ni-Cr-Fe alloys, for example U-shaped tubes, are liable to suffer stress corrosion cracking, especially in chlorine ion containing environment of high temperatures and high pressures. There have been proposed many measures for overcoming this defect, such as removal of residual stress from welded or worked pieces, improvement of corrosive environment and of design of pieces, surface processing such as shot peening, and employment of Ni alloy containing a high percentage of nickel like Inconel (trade name).

These measures, however, are expensive to conduct and as such, are unsatisfactory from commercial point of view.

Accordingly, the object of the invention is to provide Ni-Cr-Fe alloys improved in resistance to stress corrosion cracking.

It is a further object of the invention to provide Ni-Cr-Fe alloys improved in resistance to the stress corrosion cracking which is liable to occur in pure water, chlorine ion containing water or vapor thereof at high temperatures and high pressures.

It is a still further object of the invention to provide a long lasting heat exchanger for a nuclear reactor.

Other objects and advantages of the invention will become apparent from the following description.

After a considerable amount of research, we discovered that mode of stress corrosion cracking in Ni-Cr stainless steels or Ni-Cr-Fe alloys varies highly depending on conditions of the corrosive environment which is surrounding the steel or alloy. There has usually been employed boiling solution of magnesium chloride as a test medium for examining stress corrosion cracking. In this test medium, the stress corrosion cracking of Ni-Cr stainless steels or Ni-Cr-Fe alloys, is observed mainly as intergranular cracking. On the other hand, the corrosive environment is which the heat exchangers for a nuclear reactor is positioned, that is, pure water, chlorine ion containing water or vapor thereof at high temperatures and high pressures causes in Ni-Cr stainless steels or Ni-Cr-Fe alloys a stress corrosion cracking appearing not only as intergranular cracking but also as transgranular cracking. As such, the stress corrosion cracking in the latter case cannot be estimated from the test result employing boiling solution of magnesium chloride as a test medium.

We have found that the susceptibility of Ni-Cr stainless steel or Ni-Cr-Fe alloys to the stress corrosion cracking in the latter case is markedly affected by the carbon content dissolved in solid solution with the matrix of the steels or the alloys. Particularly, more than 0.03 weight % of carbon adversely affects the resistance to stress corrosion cracking of the above steels or alloys. We suppose that this degradation in resistance to stress corrosion cracking is caused by formation of chromium carbide $Cr_{23}C_6$ in the vicinity of the grain boundary on heating the steels or the alloys to a temperature of about 500° to 800° C and the resultant chronium-depleted area a that portion. Such effect of carbon is not observable in the corrosive environment of boiling magnesium chloride.

Therefore, it is desirable to restrict the carbon content to less than 0.03% in order to prevent the stress corrosion cracking in the environment of pure water, chlorine ion containing water or vapors thereof at high temperatures and high pressures. However, such low carbon Ni-Cr stainless steels or Ni-Cr-Fe alloys are expensive to produce in mass-scale. Thus, we endevoured to modify the chemical compositions of such steels or alloys in order to endow the resistance to stress corrosion cracking while the carbon content being maintained at a high order.

Our research works carried out to develop this possibility disclosed that the above-mentioned susceptibility to stress corrosion cracking due to the high carbon content can be supressed by incorporating at least one element of titanium, niobium, zirconium and tungsten.

We discovered that addition of vanadium and/or aluminum to Ni-Cr stainless steel or Ni-Cr-Fe alloy remarkably increases the resistance to stress corrosion cracking in the corrosion environment of pure water, chlorine ion containing water or vapor thereof at high temperatures and high pressures. We also found that addition of silicon is effective for preventing transgranular cracking although not effective for preventing intergranular cracking. For preventing the stress corrosion cracking, it is also preferable to make the alloy structure austenite.

Based on the above discoveries, this invention provides an Ni-Cr-Fe alloy being improved in resistance to stress corrosion cracking, consisting essentially of, by weight; 0.03 to 0.12% of carbon; 0.2 to 4.0% of silicon; 0.1 to 3% of maganese; 12 to 45% of nickel, 15 to 35% of chromium, at least one element selected from the group consisting of vanadium and aluminum, the total amount of vanadium and aluminum being in the range of 0.2 to 4.0%; at least one element selected from the group consisting of titanium in an amount of at least 5 times the carbon content and up to 1% of the total composition, niobium in an amount of at least 7 times the carbon content and up to 1% of the total composition, zirconium in an amount of 7 times the carbon content and up to 1 % of the total composition, and tungsten in an amount of at least 5 times the carbon content and up to 2 % of the total composition, the total amount of any combination of the group consisting of titanium, niobium, zirconium and tungsten being in the range of 0.3 to 2 %, at least one element selected from the group consisting of copper and molybdenum, the total amount of copper and molybdenum being up to 4 %; and the balance essentially of iron.

According to the most preferred embodiment of this invention, there is provided an Ni-Cr-Fe alloy being improved in resistance to stress corrosion cracking, consisting essentially of, by weight; 0.03 to 0.12 % of carbon; 1.5 to 4.0 % of silicon; 0.1 to 3 % of manganese; 25 to 45% of nickel; 24 to 35% of chromium; 0.9 to 4.0% of vanadium; at least one element selected from the group consisting of titanium in an amount of at least 5 times the carbon content and up to 1% of the total composition, niobium in an amount of at least 7 times the carbon content and up to 1% of the total composition, zirconium in an amount of at least 7 times the carbon content and up to 1 of the total composition, and tungsten in an amount of at least 5 times the carbon content and up to 2% of the total composition, the total amount of any combination of the group consisting titanium, niobium, zirconium and tungsten being in the range of 0.3 to 2%, at least one element selected from the group consisting of copper molybdenum, the total amount of copper and molybdenum being up to 4%; and the balance essentially of iron.

The reasons for the restriction on the chemical composition are as follows:

carbon content exceeding 0.12% develops susceptibility to intergranular corrosion cracking and heightens the temperature at which the solution treatment is effected, resulting in oxidation and grain growth of the alloy. On the other hand, carbon content less then 0.03% is undesirable from the technical and commercial view point. Thus, the carbon content is restricted to the range of 0.03 to 0.12%.

Regarding the silicon content, an amount of at least 0.2% is required for deoxidation of the alloy and for affording the resistance to transgranular cracking. A silicon content of more than 4.0% adversely affects the weldability and workability of the resulting alloy.

According to the most preferred embodiment of the invention, the alloy contains silicon of 1.5 to 4.0%. With a silicon content of less than 1.5%, the alloy has not a sufficient resistance to stress corrosion cracking to withstand the 2,000 hours test as described hereinafter.

Regarding magnesium, a content of less than 0.1% offers some difficulties in deoxidation and hot working of the alloy. On the other hand, a manganese content exceeding 3.0% presents some problems in alloy making and working.

Regarding vanadium and aluminum, these elements serve to afford resistance to stress corrosion cracking. These elements in a total amount of less than 0.2% do not a significant effect on the property, and a total amount exceeding 4.0% adversely affects the weldability of the alloy. However, aluminum is undesirable since it adversely affects the impact properties of the alloy.

According to the most preferred embodiment of the invention, the alloy requires vanadium of 0.9 to 4.0% in order to obtain an enhanced resistance to stress corrosion.

Nickel is an austenite-forming element and affords resistance to stress corrosion cracking. A nickel content of less than 12% makes the austenite structure of the alloy unstable and deteriorates resistance to stress corrosion cracking. In fact, the higher the nickel content, the more effectively the resistivity to stress corrosion cracking is enhanced. However, since nickel is an expensive element, the upper limit of the nickel content is set at 45% from the economical view point.

Chromium serves also effective for resistance to stress corrosion cracking. A chromium content less than 15 does not afford a sufficient resistance. When the chromium content exceeds 35 %, difficulties are presented in working the alloy.

According to the most preferred embodiment of the invention, the chemical composition of the alloy is set up so that the resulting alloy is maintained substantially in the single phase of austenite and has a sufficient resistance to stress corrosion cracking to withstand the 2,000 hours test described hereinafter. Therefore, the alloy preferably contains 25 to 45% of nickel and 24 to 35% of chromium.

The alloy of this invention may contain copper and/or molybdenum, particularly when an enhanced resistance to the ordinary corrosion, such as by most oxidizing agent, is desired. The total amount of copper and/or molybdenum is preferably in the range of 0.3 to 4.0%, in which range these elements does not affect the resistance to stress corrosion cracking. A molybdenum and/or copper in a total amount less than 0.3% does not afford any significant improvement in the ordinary corrosion resistance, But, these elements in a total amount exceeding 4.0% adversely affect the resistance to stress corrosion cracking.

The present invention will be further explained by way of examples which are to be only for explanation and does by no means limit the scope of the invention.

Example

Specimens each having chemical composition shown in Table 1 and being in the shape of 2 mm in thickness, 10 mm in width and 75 mm in length were prepared.

Table 1

| | Chemical Analysis (weight %) | | | | | | | | | | | | | |
|---|---|---|---|---|---|---|---|---|---|---|---|---|---|---|
| No. | C | Si | Mn | P | Cu | Ni | Cr | Mo | V | Al | Ti | Nb | W | Zr |
| A - 1 | 0.04 | 1.71 | 1.62 | 0.008 | 25.55 | 24.82 | 2.06 | 1.96 | — | 0.41 | — | — | — | |
| A - 2 | 0.04 | 1.84 | 1.51 | 0.012 | 0.01 | 26.01 | 24.83 | 0.01 | 1.34 | — | 0.48 | — | — | — |
| A - 3 | 0.04 | 1.86 | 1.49 | 0.012 | 0.01 | 26.24 | 24.91 | 0.01 | 1.41 | — | — | 0.59 | — | — |
| A - 4 | 0.04 | 2.14 | 1.55 | 0.013 | 0.01 | 26.52 | 24.81 | 0.01 | 1.45 | — | — | 0.26 | 1.14 | — |
| A - 5 | 0.05 | 1.95 | 1.42 | 0.015 | 0.01 | 26.89 | 25.01 | 0.01 | 1.52 | — | 0.30 | — | 1.03 | — |
| A - 6 | 0.04 | 1.92 | 1.46 | 0.015 | 0.01 | 35.12 | 25.36 | 0.01 | 1.24 | — | 0.42 | — | — | — |
| A - 7 | 0.05 | 2.23 | 1.43 | 0.013 | 0.01 | 26.82 | 25.04 | 0.01 | 1.82 | — | — | 0.33 | — | 0.35 |
| A - 8 | 0.05 | 2.12 | 1.64 | 0.011 | 0.01 | 26.92 | 24.98 | 2.12 | 1.36 | 0.46 | — | — | — | — |
| A - 9 | 0.04 | 1.87 | 1.61 | 0.011 | 1.56 | 26.43 | 25.09 | 0.01 | 1.43 | — | — | 0.63 | — | — |

Table 1-continued

| No. | C | Si | Mn | P | Cu | Ni | Cr | Mo | V | Al | Ti | Nb | W | Zr |
|---|---|---|---|---|---|---|---|---|---|---|---|---|---|---|
| | Chemical Analysis (weight %) | | | | | | | | | | | | | |
| A - 10 | 0.04 | 1.81 | 1.43 | 0.013 | 0.92 | 25.16 | 25.21 | 2.08 | 1.53 | — | 0.41 | — | — | — |
| B - 1 | 0.04 | 2.16 | 1.54 | 0.013 | 0.01 | 25.08 | 20.07 | 0.01 | 0.93 | — | 0.32 | — | — | — |
| B - 2 | 0.04 | 2.10 | 1.53 | 0.016 | 0.01 | 24.90 | 20.28 | 0.01 | 2.13 | — | — | 0.53 | — | — |
| B - 3 | 0.05 | 2.40 | 1.26 | 0.015 | 0.01 | 25.02 | 19.89 | 0.01 | 2.03 | | | 0.32 | 1.11 | |
| B - 4 | 0.05 | 2.72 | 1.54 | 0.015 | 0.01 | 16.63 | 18.02 | 0.01 | 2.07 | | 0.15 | | 1.02 | |
| B - 5 | 0.04 | 2.51 | 1.55 | 0.013 | 0.01 | 16.40 | 18.15 | 0.01 | 0.97 | | | 0.49 | | |
| B - 6 | 0.04 | 2.43 | 1.36 | 0.011 | 0.01 | 25.11 | 24.88 | 0.01 | 0.01 | 0.93 | 0.33 | | | |
| B - 7 | 0.06 | 1.66 | 1.51 | 0.016 | 0.01 | 25.31 | 24.92 | 0.01 | 0.83 | | 0.78 | | | |
| B - 8 | 0.05 | 1.52 | 1.44 | 0.014 | 0.01 | 25.22 | 25.08 | 0.01 | 1.01 | 1.00 | | 0.28 | | 0.35 |
| B - 9 | 0.05 | 1.36 | 1.33 | 0.012 | 0.01 | 25.62 | 24.77 | 0.01 | 0.97 | 0.85 | 0.44 | | | |
| B - 10 | 0.06 | 2.08 | 1.36 | 0.012 | 0.01 | 25.44 | 19.91 | 2.13 | 2.15 | | | 0.72 | | |
| B - 11 | 0.04 | 1.38 | 1.46 | 0.013 | 2.08 | 24.82 | 24.63 | 0.01 | 0.01 | 1.02 | | 0.55 | | |
| C - 1 | 0.08 | 2.65 | 1.46 | 0.012 | <0.01 | 16.11 | 17.75 | <0.01 | 1.89 | | | | | |
| C - 2 | 0.07 | 1.47 | 1.36 | 0.013 | <0.01 | 24.95 | 19.69 | <0.01 | | 0.95 | | | | |
| C - 3 | 0.06 | 2.16 | 1.31 | 0.015 | <0.01 | 16.26 | 18.03 | <0.01 | 0.95 | | 0.15 | | | |
| C - 4 | 0.06 | 2.29 | 1.35 | 0.013 | <0.01 | 16.52 | 17.55 | <0.01 | | 1.15 | | 0.19 | | |
| C - 5 | 0.04 | 1.84 | 1.41 | 0.012 | <0.01 | 24.81 | 20.52 | <0.01 | | 0.90 | 1.22 | | | |
| C - 6 | 0.05 | 1.96 | 1.62 | 0.010 | <25.01 | 19.88 | <0.01 | 1.98 | | | 1.32 | | | |
| D - 1 | 0.03 | 0.28 | 0.19 | 0.005 | 0.01 | 75.24 | 15.63 | 0.01 | <0.01 | | | | | |
| D - 2 | 0.05 | 0.62 | 1.22 | 0.023 | 0.06 | 33.05 | 21.12 | 0.01 | <0.01 | | | | | |
| D - 3 | 0.06 | 0.65 | 1.78 | 0.025 | 0.07 | 9.25 | 18.65 | 0.06 | | | | | | |
| D - 4 | 0.06 | 0.54 | 1.66 | 0.023 | 0.23 | 13.30 | 16.50 | 2.14 | | | | | | |
| D - 5 | 0.06 | 0.60 | 1.75 | 0.022 | 0.07 | 11.10 | 17.50 | 0.06 | | | 0.44 | | | |
| D - 6 | 0.05 | 0.66 | 1.69 | 0.024 | 0.07 | 11.70 | 17.60 | 0.07 | | | | 0.71 | | |

These specimens were subjected to solution treatment (specimens A-1 to A-10, B-1 to B-11 and C-1 to C-6 were water-cooled after heating at 920° C; specimen D-'was water-cooled after heating at 920° C; specimen D-2 was water-cooled after heating at 1150° C; and specimens D-3 to D-6 were water-cooled after heating at 1100° c), and another set of said specimens were subjected to the sensitization treatment of air-cooling after heating to 677° for 5 hours.

Pairs of the thus treated specimens were laid over one another and bent with mandrel 7.5 mm in radius into a double U-shape. These specimens were tested to evaluate the degree of the resistance to stress corrosion cracking in water and steam at 300° C which contained chlorine ion (550 ppm; added as NaCl) and had been saturated with dissolved oxygen (at room temperature). The tests were continued under substantially the same condition maintained by changing the chlorine ion containing water every 100 hours until the occurrence of cracking was observed and up to 1000 hours if it was not observed. The result of the above test is illustrated in Table 2.

Table 2

| Evaluation | Time to cracking (hr) | | | | | | | |
|---|---|---|---|---|---|---|---|---|
| | Liquid phase | | | | Vapor phase | | | |
| Phase No. | Solution treatment | | Sensitization treatment | | Solution treatment | | Sensitization treatment | |
| A - 1 | NC | NC | NC | NC | NC | NC | NC | NC |
| A - 2 | NC | NC | NC | NC | NC | NC | NC | NC |
| A - 3 | NC | NC | NC | NC | NC | NC | NC | NC |
| A - 4 | NC | NC | NC | NC | NC | NC | NC | NC |
| A - 5 | NC | NC | NC | NC | NC | NC | NC | NC |
| A - 6 | NC | NC | NC | NC | NC | NC | NC | NC |
| A - 7 | NC | NC | NC | NC | NC | NC | NC | NC |
| A - 8 | NC | NC | NC | NC | NC | NC | NC | NC |
| A - 9 | NC | NC | NC | NC | NC | NC | NC | NC |
| A - 10 | NC | NC | NC | NC | NC | NC | NC | NC |
| B - 1 | NC | NC | NC | NC | NC | NC | NC | NC |
| B - 2 | NC | NC | NC | NC | NC | NC | NC | NC |
| B - 3 | NC | NC | NC | NC | NC | NC | NC | NC |
| B - 4 | NC | NC | NC | NC | NC | NC | NC | NC |
| B - 5 | NC | NC | NC | NC | NC | NC | NC | NC |
| B - 6 | NC | NC | NC | NC | NC | NC | NC | NC |
| B - 7 | NC | NC | NC | NC | NC | NC | NC | NC |
| B - 8 | NC | NC | NC | NC | NC | NC | NC | NC |
| B - 9 | NC | NC | NC | NC | NC | NC | NC | NC |
| B - 10 | NC | NC | NC | NC | NC | NC | NC | NC |
| B - 11 | NC | NC | NC | NC | NC | NC | NC | NC |

Table 2-continued

| Evaluation | Time to cracking (hr) | | | | | | | |
|---|---|---|---|---|---|---|---|---|
| | Liquid phase | | | | Vapor phase | | | |
| Phase No. | Solution treatment | | Sensitization treatment | | Solution treatment | | Sensitization treatment | |
| C - 1 | 700 | 700 | 200 | 100 | 600 | 400 | 200 | 300 |
| C - 2 | 600 | 800 | 200 | 200 | 500 | 600 | 200 | 100 |
| C - 3 | 700 | 800 | 200 | 200 | 800 | 800 | 100 | 300 |
| C - 4 | 600 | 900 | 200 | 100 | 700 | 500 | 200 | 100 |
| C - 5 | 500 | 700 | 400 | 500 | 500 | 900 | 600 | 400 |
| C - 6 | 400 | 800 | 600 | 700 | 600 | 700 | 500 | 700 |
| D - 1 | NC | NC | 300 | 500 | NC | NC | 500 | 500 |
| D - 2 | 500 | 400 | 200 | 200 | 500 | 300 | 200 | 200 |
| D - 3 | 100 | 100 | 100 | 100 | 100 | 200 | 100 | 100 |
| D - 4 | 200 | 200 | 100 | 100 | 100 | 100 | 100 | 100 |
| D - 5 | 100 | 100 | 100 | 100 | 100 | 100 | 100 | 100 |
| D - 6 | 100 | 200 | 100 | 100 | 100 | 200 | 100 | 100 |

Note:
NC indicated in the Table represent the case where cracking does not appear in a 1,000-hour test.

Regarding specimens according to the most preferred embodiment of this invention (specimens of A group), the above test was further continued up to 2,000 hours and the results in this case are illustrated in Table 3.

Table 3

| No. | 2000 Hour Test | | | | |
|---|---|---|---|---|---|
| | Liquid Phase | | | Vapor Phase | |
| | Heat treatment | Solution treatment | Sensitization treatment | Solution treatment | Sensitization treatment |
| A - 1 | | NC | NC | NC | NC |
| A - 2 | | NC | NC | NC | NC |
| A - 3 | | NC | NC | NC | NC |
| A - 4 | | NC | NC | NC | NC |
| A - 5 | | NC | NC | NC | NC |
| A - 6 | | NC | NC | NC | NC |
| A - 7 | | NC | NC | NC | NC |
| A - 8 | | NC | NC | NC | NC |
| A - 9 | | NC | NC | NC | NC |
| A - 10 | | NC | NC | NC | NC |

As seen from Tables 2 and 3, specimens of A and B groups whose chemical composition fall in the scope of this invention did not exhibit cracking up to 1,000 hours in either liquid or gas phase. Particularly, specimens of A group whose chemical compositions fall in the scope of the most preferred embodiment of this invention did not exhibit any cracking up to 2,000 hours under the severe condition of said test.

Specimens of C group are standard of comparison for checking the effect of titanium, niobium, zirconium or tungsten. The amounts of these element in the alloys are outside the range of this invention. As shown in Table 2, the specimens of C group did exhibit cracking earier than 1,000 hours in both liquid and gas phases.

Specimen of D group are the commercially available alloys and stainless steels. particularly, specimen D-I is Inconel (trade name) which has been well known as possessing high resistance to corrosion. Specimen D-l did not exhibit cracking under the condition as solution treated, but exhibited cracking after 300 to 500 hours due to sensitization treatment.

Other specimens of D group (particularly, specimen D-2 is Incoloy (trade name)) exhibited cracking within several hundred hours in both liquid and vapor phases.

Example 2

In order to ascertain the effect of the addition of manganese and/or copper, several specimens of Example 1 were set for 1,000 hours under the same condition as the test of Example 1 and then determined the loss in weight due to corrosion. The results are shown in Table 4.

Table 4

| Specimen No. | Loss in weight (mg/cm²) |
|---|---|
| A - 1 | 0.08 |
| B - 2 | 0.45 |
| B - 3 | 0.92 |
| B - 10 | 0.11 |
| C - 2 | 0.76 |

As seen from Table 4, molybdenum and copper are very effective to afford the resistance to corrosion.

We claim:

1. A Ni-Cr-Fe alloy being improved in resistance to stress corrosion cracking in water, water containing chlorine ion, at high temperatures and pressures, consisting essentially of, by weight; 0.03 to 0.12% of carbon; 1.5 to 4.0% of silicon; 0.1 to 3% of manganese; 25 to 45% of nickel; 24 to 35% of chromium; 0.9 to 4.0% of vandium; at least one element selected from the group consisting of titanium in an amount of at least 5 times the carbon content and up to 1% of the total composition, niobium in an amount of at least 7 times the carbon content and up to 1% of the total composition, zirconium in an amount of at least 7 times the carbon content and up to 1% of the total composition, and tungsten in an amount of at least 5 times the carbon content and up to 2% of the total composition, the total amount of any combination of the group consisting titanium, niobium, zirconium and tungsten being in the range of 0.3 to 2%; at least one element selected from the group consisting of copper and molybdenum, the total amount of copper and molybdenum being up to 4%; and the balance essentially of iron.

2. A Ni-Cr-Fe alloy being improved in resistance to stress corrosion cracking in water, water containing chlorine ion, at high temperatures and pressures, consisting essentially of, by weight; 0.03 to 0.12% of carbon; 1.5 to 4.0% of silicon; 0.1 to 3% of manganese; 25 to 45% of nickel; 24 to 35% of chromium; 0.9 to 4.0% of vandium; at least one element selected from the group consisting of titanium in an amount of at least 5 times the carbon content and up to 1% of the total composition, niobium in an amount of at least 7 times the carbon content and up to 1% of the total composition, zirconium in an amount of at least 7 times the carbon content and up to 1% of the total composition, and tungsten in an amount of at least 5 times the carbon content and up to 2% of the total composition, the total amount of any combination of the group consisting titanium, niobium, zirconium and tungsten being in the range of 0.3 to 2%; and the balance essentially of iron.

3. A Ni-Cr-Fe alloy being improved in resistance to stress corrosion cracking in water, water containing chlorine ion, at high temperatures and pressures, consisting essentially of, by weight; 0.03 to 0.12% of carbon; 1.5 to 4.0% of silicon; 0.1 to 3% of manganese; 25 to 45% to nickel; 24 to 35% of chromium; 0.9 to 4.0% of vanadium; at least one element selected from the group consisting of titanium in an amount of at least 5 times the carbon content and up to 1% of the total composition, niobium in an amount of at least 7 times the carbon content and up to 1% of the total composition, zirconium in an amount of at least 7 times the carbon content and up to 1% of the total composition, and tungsten in an amount of at least 5 times the carbon content and up to 2% of the total composition, the total amount of any combination of the group consisting titanium, niobium, zirconium and tungsten being in the range of 0.3 to 2%; at least one element selected from the group consisting of copper and molybdenum, the total amount of copper and molybdenum being in the range of 0.3 to 4%; and the balance essentially of iron.

4. A Ni-Cr-Fe alloy being improved in resistance to stress corrosion cracking in water, water containing chlorine ion, at high temperatures and pressures, essentially consisting of by weight, 25.55% of nickel, 24.82% of chromium, 1.71% of silicon, 1.62% of manganese, 0.90% of copper, 2.06% of molybdenum, 1.96% of vandium, 0.41% of titanium, 0.04% of carbon, and traces of phosphorus.

* * * * *